United States Patent [19]

Löffelholz

[11] 4,129,312

[45] Dec. 12, 1978

[54] SKI POLE

[76] Inventor: Eberhard Löffelholz, Thurgauerstrasse 13a, D-77 Singen, Germany

[21] Appl. No.: 786,254

[22] Filed: Apr. 11, 1977

[30] Foreign Application Priority Data

Apr. 14, 1976 [DE] Fed. Rep. of Germany ..... 2616431

[51] Int. Cl.[2] ..... A63C 11/02; A63C 11/18

[52] U.S. Cl. ..... 280/11.37 Z; 280/11.37 L; 280/11.37 P; 280/11.37 E; 280/11.37 K

[58] Field of Search ..... 280/11.37 B, 11.37 H, 280/11.37 P, 11.37 N, 11.37 Z, 11.37 A, 11.37 E, , 11.37 K; 15/237

[56] References Cited

U.S. PATENT DOCUMENTS

| | | | |
|---|---|---|---|
| 3,199,886 | 8/1965 | Dover | 280/11.37 Z |
| 3,354,675 | 11/1967 | Quigg | 280/11.37 K |
| 3,576,332 | 4/1971 | Bruckl | 280/11.37 H |
| 3,687,472 | 8/1972 | Struble, Jr. | 280/11.37 B |
| 3,866,931 | 2/1975 | Marker | 280/11.37 B |

FOREIGN PATENT DOCUMENTS

| | | | |
|---|---|---|---|
| 2218731 | 10/1973 | Fed. Rep. of Germany | 280/11.37 A |
| 2413204 | 10/1974 | Fed. Rep. of Germany | 280/11.37 Z |
| 1267305 | 6/1961 | France | 280/11.37 Z |
| 1285357 | 1/1962 | France | 280/11.37 E |
| 56134 | 1/1936 | Norway | 280/11.37 E |
| 75641 | 9/1949 | Norway | 280/11.37 E |
| 7314624 | 4/1975 | Sweden | 280/11.37 Z |
| 453990 | 6/1968 | Switzerland | 280/11.37 P |

*Primary Examiner*—David M. Mitchell

*Attorney, Agent, or Firm*—Hane, Roberts, Spiecens & Cohen

[57] ABSTRACT

There is disclosed a ski pole provided with a disk mounted at one end above the tip of the pole and a handle grip at the other side of the pole. At least one scraper part projects from the disk to clean the skis, the soles of ski boots and other objects having a flat surface to be cleaned.

29 Claims, 15 Drawing Figures

Fig. 1
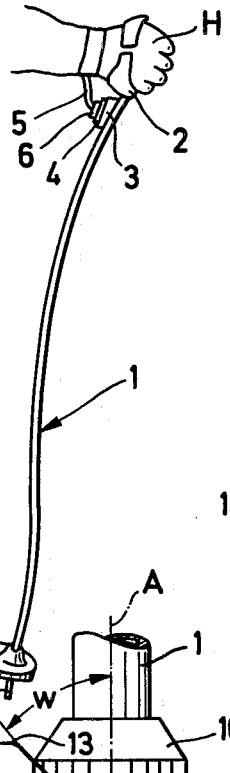
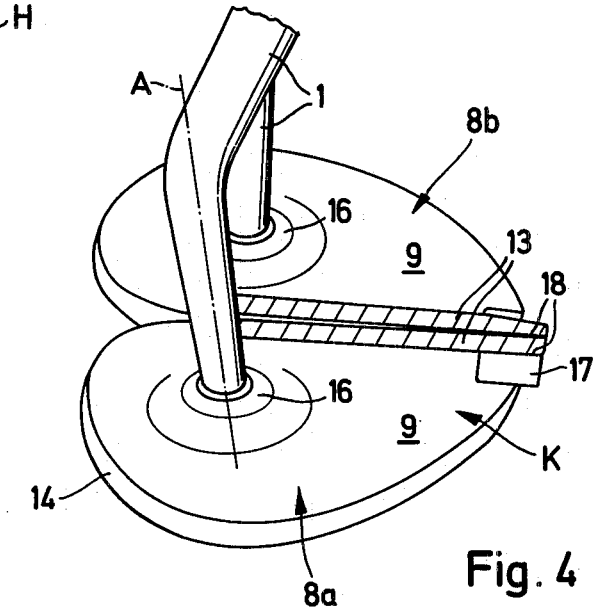
Fig. 4
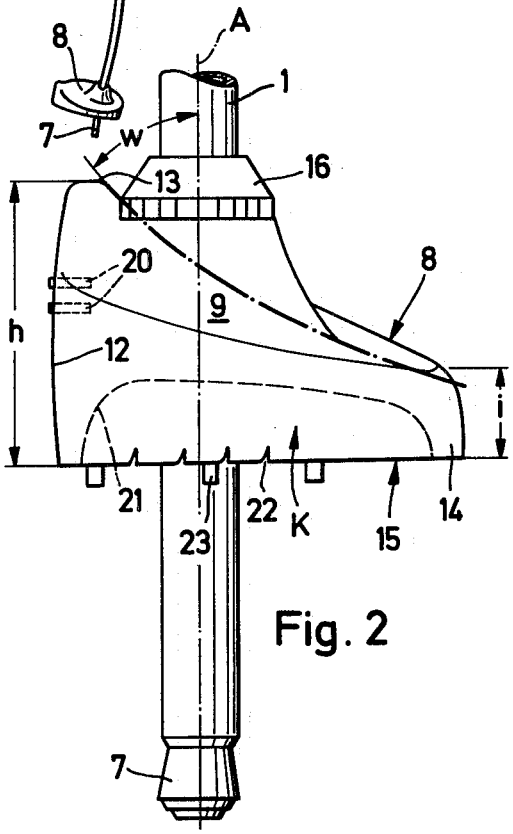
Fig. 2
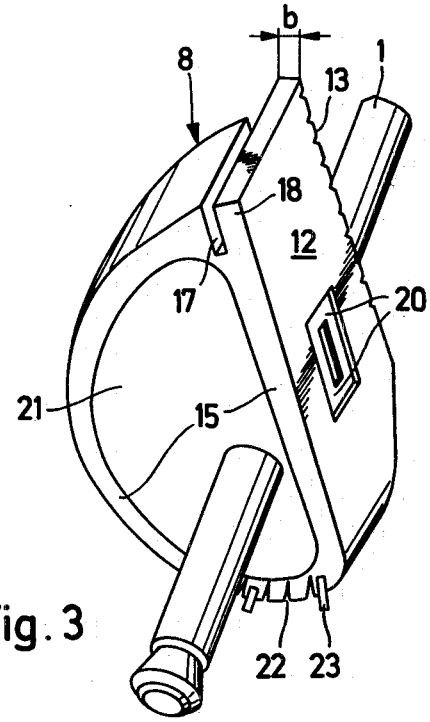
Fig. 3

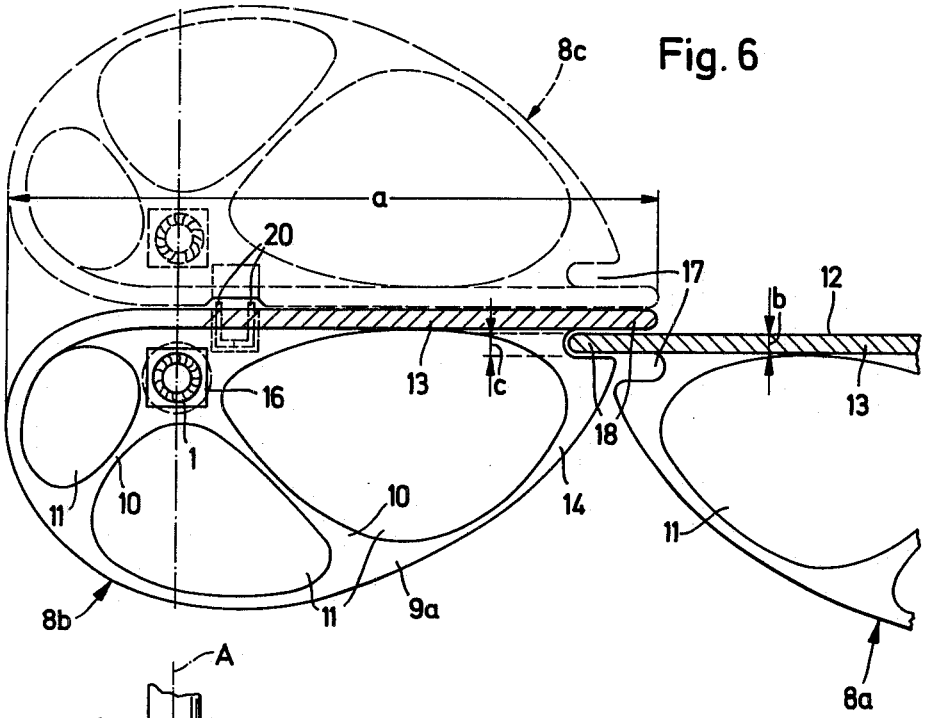
Fig. 6
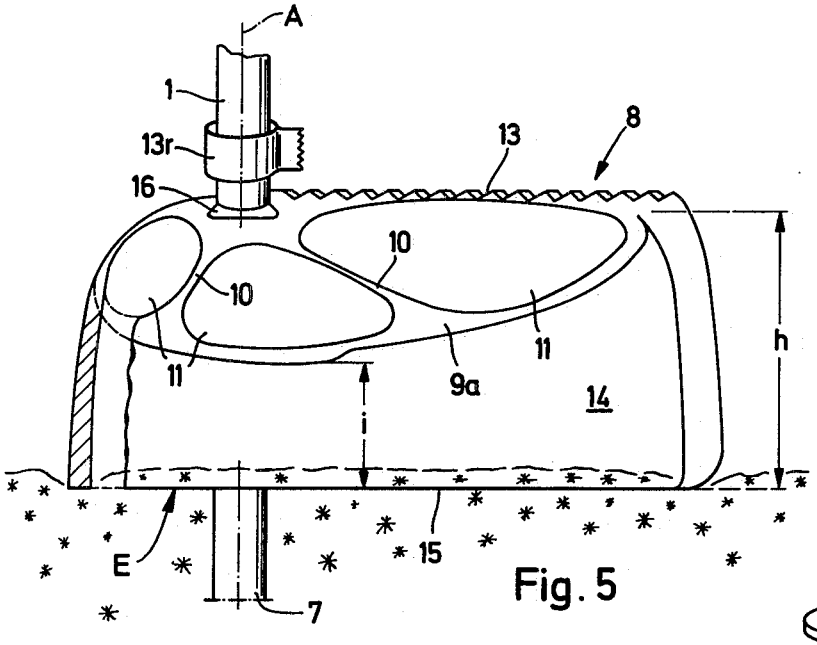
Fig. 5
Fig. 7
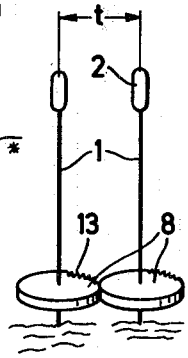

Fig. 8
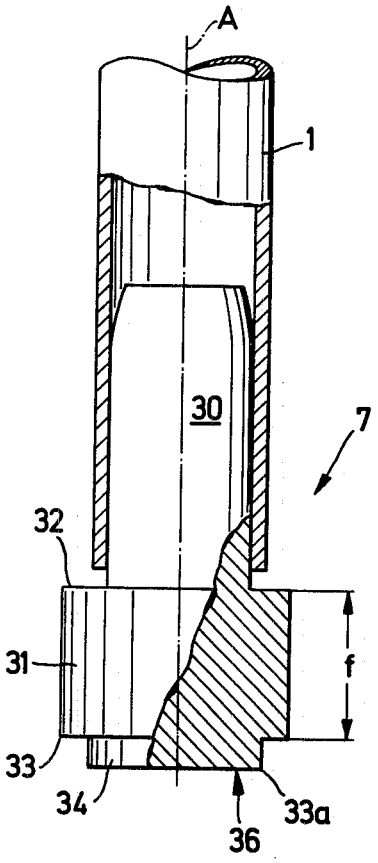
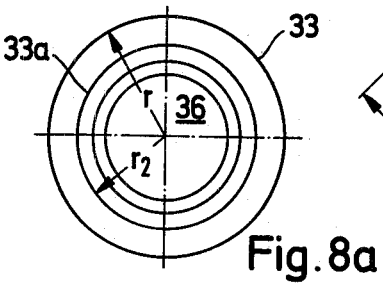
Fig. 8a
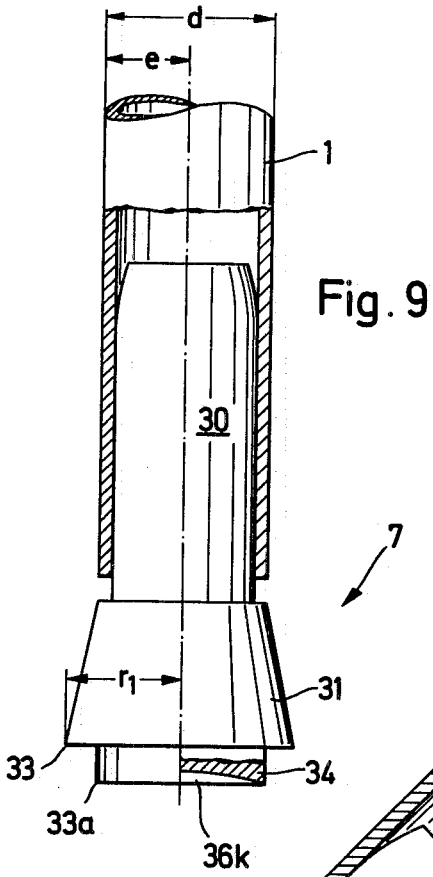
Fig. 9
Fig. 10
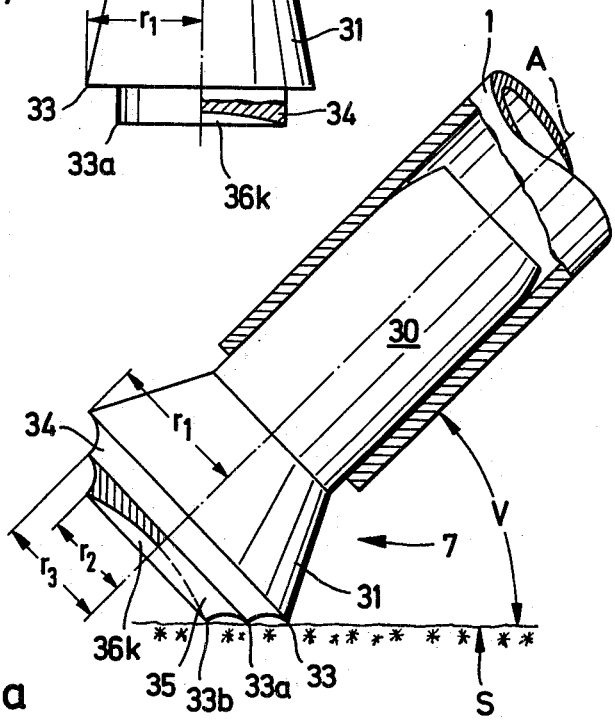

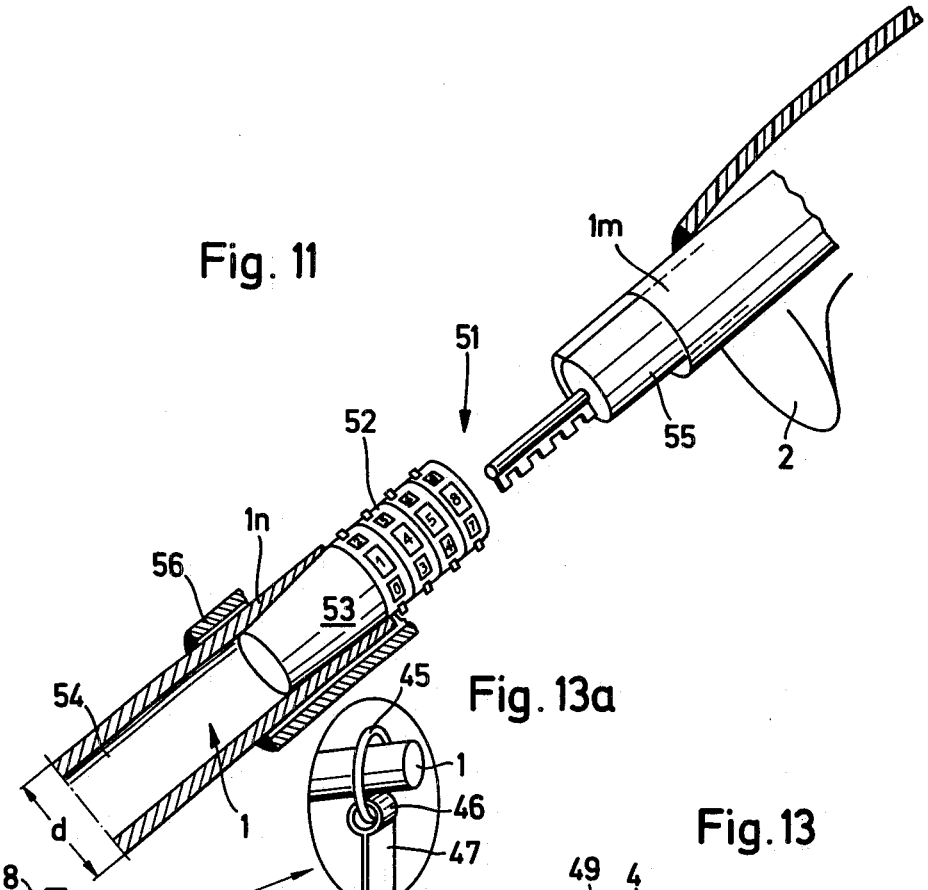
Fig. 11
Fig. 13a
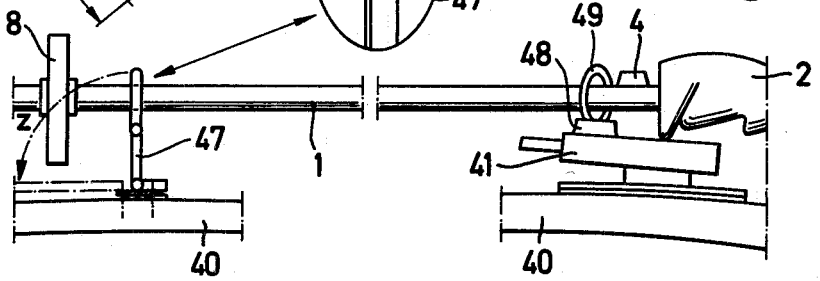
Fig. 13
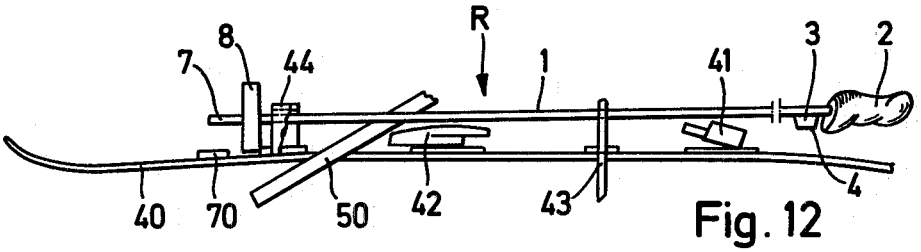
Fig. 12

SKI POLE

This invention relates to a ski pole or pair of ski poles with disk arranged at one end of the ski pole above its tip and pole grip provided on the other end.

Every skier considers the snow which accumulates below the soles of the ski boot as particularly troublesome when he is about to fasten the ski to his boot. Ordinarily, the boot is freed from the snow by the use of a branch which is lying about, or an automobile windshield scraper, with its potential for accidents, is carried in the ski pants pocket. So-called anti-snow soles which have been recently placed in the foreground by the ski industry acknowledge the problem but are ineffective in actual practice since the sole must not be smooth in order to avoid dangerous "slippage" on the way to the run and therefore snow constantly accumulates. In modern skiing, furthermore, the precise contact between boot and ski without intervening snow or ice is of utmost importance for controlled travel and for the proper operation of the safety or automatic binding. This is true not only for Alpine skiing but is of importance, in part, in similar fashion also for cross-country skiing.

Furthermore, every skier is acquainted with the problem of now and then having to tie his skis up together with their corresponding poles so as to form a single unit, either for easier transportation or to provide assurance against theft. Thus it has become customary to tie the skis and ski poles together by means of straps. Since straps, on the one hand, are scarcely capable of preventing theft and on the other hand are being used to a decreasing extent, a carrying frame consisting of straps and bars together with carrying handles has been developed which obviously was not able to gain introduction into practice because of its complicated nature.

Special devices which must be attached to the body of the skier during the skiing itself obviously get in the way and are therefore rejected.

It was the goal of the inventor to eliminate these defects and create an accident-proof device for the eliminating of snow and ice from the ski boot which can be carried along without expense during skiing, as well as to secure the ski poles against theft. The carrying along of special scraping members and padlocks is to be avoided and safety improved as a whole for the skier.

For the solution of this problem a ski pole is provided whose disk has at least one scraping member extending from it for the cleaning of the soles of ski boots or similar articles and can be fastened possibly by coupling members to another ski pole and/or disk. In this connection — in accordance with another feature of the invention — the ski pole is to be divided at least once, with the interposition of at least one lock connected with it or of a corresponding interlocking closure member transverse to its tubular or bar axis and/or be separable from the disk or pole grip.

It has been found particularly favorable in accordance with the invention to cause two disks with the ski poles extending through them in connected position of use and possibly with fixed pole tips, to form a frame for the scraping members which extend from the disks and/or the ski pole. In this connection the distance between the ski poles which are connected with each other by the disks should be greater than the outer width of the ski boot which is to be cleaned.

A skier who is equipped with such ski poles can scrape his ski boots off in the position of support customary for him with arms bent and both pole grips held in front of his chest or supported under his armpits, in absolutely safe position. While he continues to support himself — and therefore does not lose his equilibrium — he steps into the binding of the ski which is ready to receive him. There is no troublesome stooping on one leg which endangers one's equilibrium while at the same time helping out generally with one's hand or fingernails, and falls are thus avoided. It has been found favorable to mount a small mirror on the corresponding ski in addition in order to observe the sole of the ski boot.

The invention includes a tear-shaped development of the contour of the disk so that a narrow disk end is produced; it bears pins or similar elements which can be inserted in recesses which are provided predominantly on the edges of the disk.

A tear-shaped ski pole disk whose contour is formed by a correspondingly shaped ring on which the scraping edge is provided elevated in the form of a comb and the principal plane of which forms an angle of preferably 45 to 60° with the pole has proven particularly favorable. If these ring disks are placed over each other they offer two approximately parallelly extending scraping edges. This is true also of another embodiment in which the disks are each formed of a compact body of plastic.

An annular bushing for the ski pole possibly having a square cross section within which the ski pole is not able to turn should preferably be provided eccentrically in each disk.

The shape of the ski-pole disk has proven to be particularly important for safety and ease of handling; the height of the cross section of the disk located transverse to the longitudinal axis of the plan view over a plane determined by the lower edge of the disk, from the so-called comb side bearing the scraping members should decrease towards the opposite longitudinal side of the disk — the surface of the disk is thus inclined away from the user towards the axis of the ski pole.

The high comb side of the disk ends in accordance with the invention in the form of a horn or the like alongside of which there is provided a slot parallel thereto into which the horn of the opposing disk is inserted in clamping fashion.

In another illustrative embodiment, the coupling members described can also be replaced by permanent magnets which, to be sure, have the disadvantage that in their normal execution they cannot withstand the pressure of the ski boot which is to be cleaned.

Therefore it has been found favorable to provide permanent magnets on at least one side surface of the blockshaped ski disk; if the sides of the disks of a pair of ski poles are placed against each other, they can hold the ski poles together for transportation and storage.

The special shape of the ski tips is also of importance for the stability of the ski poles in accordance with the invention as well as for the reliability of the handling thereof; gripping power on ice is specifically of particular importance on the much traveled downhill runs which today are becoming more and more icy. Ski poles which slip away upon oblique striking on ice are not only very energy-consuming for the arm which strikes into emptiness but are also in particular susceptible to accidents. This is true not only for downhill travel but also for ascents in hard or iced tracks.

As less harmful alternative for the traditional cone-shaped tips there have recently become known so-called crown tips whose gripping power, however, leaves something to be desired, particularly if the hollow space between the individual points of the so-called crown become dirty.

There is offered as solution for this the use of a tip which is arranged possibly detachably on the ski pole and which has at least one annular edge as well as a front surface; the tip of the ski pole preferably will have a plurality of annular edges forming concentric steps with radii which decrease towards the front surface. The front surface can furthermore be made concave.

In accordance with another feature of the invention, at least one of the annular edges is formed of a cylindrical or conical body of circular or oval cross section on which a pin can be provided for insertion into the tubular ski pole.

In a special embodiment of the ski-pole tip a plurality of conical frustums are arranged one above the other, the base of each of them forming a separate annular edge.

The aforementioned protection against theft and simplification of handling resulting from a divided ski pole with built-in lock affords the possibility of supplementing pole, ski and holding members into a single closed frame-like unit. The lock is part of the ski pole which, after the opening of the lock, can be taken apart and introduced into the holding members for the ski, for instance loops of straps or the like. The frame thus produced clearly facilitates the carrying of the bundle of skis and permits also fastening on bolts or bars, clamped at both ends, of garden fences, doors, or similar elements which are to be found in the vicinity of all ski resorts.

Particularly advantageous is a bipartite pole in one part of which the bolt member of a lock can be fastened and in the other part of which there can be fastened a bit member, which can be inserted — possibly axially — into the bolt member and held there in locked position. For this, there is particularly suitable, for instance, an ordinary combination lock such as used as bicycle locks. This combination lock is of cylindrical development; the axial halves of the locks can be inserted without difficulty one in the other and then form a unit which is resistant to tension and compression.

One side of such a lock can even be provided on the ski itself so that the pole is locked directly to the ski and the holding members mentioned above are eliminated.

Of particular importance for the development of a ski pole is the possibility in accordance with the invention of arranging the bipartite lock close to the grip of the pole; at this place it fulfills all the functions already mentioned and in addition makes it possible to change the grip itself.

If the locks of two ski poles which belong together are mounted opposite each other, i.e. for instance, the bolt piece on one pole on the handle side and on the other pole in the section of the pole bearing the disk, then these poles can in emergencies even be connected together to form a long rod to be used as snow probe or the like.

Further advantages, features, and details of the invention will be evident from the following description of preferred embodiments and by reference to the drawing in which:

FIG. 1 is an oblique view of a ski pole;

FIG. 2 shows the enlarged tip of the ski pole with ski pole disk;

FIG. 3 is an oblique bottom view beneath the ski pole disk;

FIG. 4 is an oblique view onto the lower part of two ski poles which are connected together;

FIG. 5 is a side elevation of a ski pole disk;

FIG. 6 is a top view of two ski pole disks which are connected together;

FIG. 7 is an assembly sketch, on a reduced scale, with two ski poles;

FIG. 8 shows the partially cut end of the ski pole with associated plan view (FIG. 8*a*);

FIG. 9 shows another embodiment in a showing corresponding to FIG. 8;

FIG. 10 shows the partially cut side view of a ski pole top placed at an angle on ice;

FIG. 11 is a longitudinal section through the upper part of a transversely divided ski pole;

FIG. 12 is a side view of a ski pole mounted on a ski;

FIG. 13 is an enlarged detail from FIG. 12 concerning another embodiment with emphasis of a partial cross section (FIG. 13*a*).

On a curved ski pole 1 below the glove H of the user — not further shown — holding the pole handle 2 there can be noted a shaped part 3 whose surface is provided with a magnet 4; the latter holds in inclined position a parallele piped magnet 6 which swings on a strap 5 of the glove H.

Above the pole tip 7 there is provided a disk 8 of approximately tear-shape with closed surface 9. The embodiments of the disk 8 shown in FIGS. 5 and 6 have an open surface $9_a$ with three openings 11 separated by webs 10.

The entire length a of for instance 12 cm of the disk 8 is determined by its so-called comb side 12 of a height h of about 5 cm which terminates towards the pole grip 2 in an edge 13 profiled in comb shape. Adjoining the comb side 12 there is a swept — in plan view approximately oval — disk outside 14 whose height decreases from the comb side 12 down to a minimum height i of about 2 cm. The two heights h, i determine, over the lower edge 15 of the disk 8 lying in a plane E, the inclination of the surface 9; the angle of inclination w enclosed between the pole axis A and the auxiliary line G (FIG. 2) amounts to about 45°.

From the inclined surface 9 there extends upward a fastening ring 16 for the connecting of ski pole 1 and disk 8.

On the tip of the "tear" as seen in plan view there is provided between the comb edge 13 and the disk body K a slot 17 whose width c is slightly greater than the thickness b of the fin-shaped extension 18 of the comb side 12; this extension 18 of the one disk 8*a* can, as shown in FIG. 6, be inserted into the slot 17 of the other disk $8_b$ of a pair of ski poles $1_b$ and then forms with the latter a firm H-shaped structure (FIG. 7). As a result of the elasticity of the disks 8 which are made of plastic, the extensions or horns 18 hold the two ski poles 1 at a distance t apart; a skier who supports himself on one foot forms a stable system with these two ski poles 1 when he pulls the other foot over the comb edge 13. In this connection the sole of the ski boot which contacts the two comb edges 13 is freed by the latter from adherent dirt and snow. Side dirt extending laterally from the ski boot is removed by scraping elements $13_r$ which protrude radially from the ski pole 1.

FIG. 6 in particular shows the placing together of the disks 8*a* and 8*b* by insertion of the horn 18 of one ski pole disk 8*a* into the slot 17 of the other ski pole disk 8*b*. Furthermore, the dashed line contour 8*c* shows the position of the ski disk 8*a* l when its comb side 12 rests, in condition of non-use, against the corresponding side of the ski pole disk 8*b* (see also FIG. 4). Both ski pole disks 8 are held to each other by permanent magnets 20 in the comb-line side 12. The permanent magnets 4 in the vicinity of the pole handle 2 can be additionally used here for connecting the two ski poles 1.

From the lower edge 15 of the disk 8 or its plane E the lower surface 21 of the ski pole disk 8 curves into the body K thereof. In the embodiments in accordance with FIGS. 2 and 3, the lower edge 15 is furthermore, for reasons of snow-gripping power, in part provided with undulated indentations 22 and with pin-shaped detent members 23.

The ski pole tip 7 is inserted, in accordance with FIG. 8, and possibly in replaceable manner, into the tubular ski pole 1 by means of a pin 30. This pin is continued outside the ski pole 1 in a collar 31 of large radius r, as compared with the pin 30, so that a shoulder 32 results towards the pole (FIGS. 8, 9). The collar 31 of axial height f is either cylindrical (FIG. 8) or widens conically to a radius $r_1$ (FIGS. 9, 10) which may be greater than the outside radius e of the ski pole 1. In all cases there is produced a lower annular edge 33 below which at least one disk-shaped concentric shoulder 34 of the radius $r_2$ having a second annular edge 33*a* is formed; in FIG. 10 a second disk shoulder 35 of small radius $r_3$ and annular edge 33*b* can be noted. The collar 31 by means of its disk shoulders 34, 35, and the annular edges 33 which become smaller in cross section forms a stepwise ski-pole end with flat end surface 36 or concavely shaped end surface 36*k*.

This ski pole tip 17 affords higher gripping power even with a flat angle of inclination v between ski pole and plane of travel S (hard snow and ice) due to the multiple circumferential annular edges 33. In order to avoid wear of the annular edges by abrasion, the ski pole tips 7 are preferably made of hardened material.

This relatively blunt ski pole tip 7 considerably reduces the customary dangers of injury; furthermore the attaching of ice to the ski pole tip is substantially prevented.

The ski pole 1 can, in accordance with FIG. 11, be detached from the pole grip 2 in order to be able to insert the ski pole 1, for protection against theft, in loop-shaped parts of corresponding skis 40.

Between a so-called heel release 41 indicated symbolically in FIGS. 12 and 13 and the front swivel iron 42 of a ski binding there can be noted an anti-slide device 43 extending approximately vertically there consisting of a U-shaped adjustment clamp which is swingable on the ski 40 and terminates in tips below same, through which clamp the ski pole is also passed.

Instead of a known grip-over guard 44 a ring 45 in the upper pipe end 46 of an arm 47 which is swingable in the direction indicated by the arrow z against the ski 40 can be used for holding the ski pole 1 fast; the diameter of said ring 45 is only slightly greater than the outer diameter d of the pole.

A loop 49 seated turnably on an appendage 48 of the heel release 41 which appendage is passed through by a slot — and was previously pulled through by an ordinary strap — corresponds to the ring 45. Ski 40 and ski pole 1, in the example selected, together with the grip-over guard 44 and the ring 45 as well as the other corresponding holding members 43 and 49 form a closed frame which — placed for instance around a clamp 50 clamped at both ends in a wall, which has not been shown in order not to clutter the drawing — serves to secure against theft the unit R consisting of ski 40 and ski pole 1; the ski pole 1 cannot be loosened from the connecting or holding members 44, 45 and 43, 49 respectively since the pole disk 8 and pole grip 2 prevent pulling-out in axial direction.

The ski pole 1 which is divided into two pole sections 1*m* and 1*u* for fastening to the ski 40 is assembled into a single unit by a built-in cylindrical lock 51; the bolt piece 52 of the combination lock 51 has its conical end 53 in the hollow space 54 of the one pole section 1*u* while the bit piece 55 of the lock 51 is cast into the section 1*m* of the pole which is close to the grip.

Due to this lock 51 (which is possibly protected by a displaceable rubber covering 56) the ski pole 1 can be used to secure the frame unit R described or else be connected merely with a wall ring or the like to prevent theft. In addition to this it is possible to connect two ski poles 1, after removal of the pole grips 2 by means of lock parts 52, 55 which are then arranged in opposite direction; a rod produced in this way can be very helpful on the ski run.

70 is a mirror glued to the ski 40 in front of the ski binding 41, 42, by means of which mirror the user can observe the soles of his ski boots.

I claim:

1. A pair of ski poles, each comprising a pole member having a hand-engaging end and a ground-engaging end, a disk having a peripheral edge, mounted on said pole member adjacent to the ground-engaging end such that a tip of the pole extends beyond said disk, for engaging the ground; scraper means on said disk for cleaning ski boot soles and other flat objects, and means on said periphery of said disk for coupling the disk with a disk of the other of said pair of ski poles to form an assembly having said poles spaced from one another, said scraper means of each disk being located proximate said coupling means and between the poles when the disks are coupled, thus providing a firm frame enabling support of a skier while the boot of the skier can be cleaned on said scraper means.

2. A ski pole as claimed in claim 1 wherein the coupling means comprises an extension and an adjacent slot on said disk, the extension of one disk being fittable with the slot of the other disk.

3. A ski pole as claimed in claim 1 wherein said disk has a tear-drop shape in plan view forming narrow and wide ends, the coupling means being at said narrow end.

4. A ski pole as claimed in claim 3 wherein said disk further includes radial reinforcing webs.

5. A ski pole as claimed in claim 3 wherein said disk is composed of a plastic material.

6. A ski pole as claimed in claim 3 wherein said disk further includes a bush eccentrically mounted in the disk and receiving said pole member.

7. A ski pole as claimed in claim 3 wherein said disk is of varying height and is a maximum at said scraper means and diminishes therefrom to a minimum height.

8. A ski pole as claimed in claim 7 wherein the variation of height of the disk between maximum and minimum is in a ratio between 2:1 and 3:1.

9. A ski pole as claimed in claim 7 wherein the coupling means comprises an extension and an adjacent slot on said disk, the extension of one disk being fittable into the slot of the other disk.

10. A ski pole as claimed in claim 7 wherein said disk has a curved upper surface.

11. A ski pole as claimed in claim 7 wherein a straight line drawn between the minimum and maximum height of the disk forms an angle of 45° with said pole member.

12. A ski pole as claimed in claim 1 wherein said disk has a lower concave surface with a beaded edge.

13. A ski pole as claimed in claim 12 wherein said beaded edge includes peg-like arresters projecting therefrom.

14. A ski pole as claimed in claim 1 including additional coupling means comprising permanent magnet means supported by said disk for joining said poles for transport.

15. A ski pole as claimed in claim 1 wherein said tip includes a peg detachably coupled to said pole member, a collar extending axially from said peg, an extension extending axially from said collar and having an end face.

16. A ski pole as claimed in claim 15 wherein said collar has concentric annular edges defining steps with said peg and extension, said steps having different radii with the step of greater radii being further from said end face.

17. A ski pole as claimed in claim 15 wherein said end face is concave.

18. A ski pole as claimed in claim 15 wherein said collar is cylindrical.

19. A ski pole as claimed in claim 15 wherein said collar is conical.

20. A ski pole as claimed in claim 1 wherein said pole member comprises separable parts and means for lockably securing said parts together.

21. A ski pole as claimed in claim 20 wherein said separable parts are separable between said hand-engaging end and said disk.

22. A ski pole as claimed in claim 21 in combination with a ski on which loop retainers are secured, said separable parts being respectively insertable into said loop retainers and then locked by said locking means to secure the pole member in said loop retainers so that said pole member can be locked to said ski.

23. A ski pole as claimed in claim 20 wherein said means for lockably securing said parts together comprises engageable lock members on said parts and a slidable sheath on one of said parts for covering said lock members when engaged.

24. A ski pole as claimed in claim 20 comprising a handgrip on said pole member at said hand-engaging end, said means for lockably securing the parts together being proximate said handgrip whereby the handgrips of two pole members can be interchanged.

25. A ski pole as claimed in claim 24 wherein the means for lockably securing the parts together comprises a bolt and cylinder, the bolt being on one part and the cylinder on the other part.

26. A ski pole as claimed in claim 25 wherein for a pair of ski poles the bolt is on one part of one ski pole and on the other part of the other ski pole.

27. A ski pole as claimed in claim 19 wherein said end face is concave.

28. A ski pole as claimed in claim 19 wherein said extension has a concave peripheral surface.

29. A ski pole as claimed in claim 19 wherein said extension includes a plurality of portions of diminishing diameter with successive annular edges.

* * * * *